US005513944A

United States Patent [19]

Cullen et al.

[11] Patent Number: 5,513,944

[45] Date of Patent: May 7, 1996

[54] ROLL HANDLING APPARATUS FOR FORK LIFT TRUCKS

[75] Inventors: Ralph E. Cullen, Arden Hills; John R. Sjolund, Crosslake, both of Minn.

[73] Assignee: N.R.S. Systems, Inc., Crosslake, Minn.

[21] Appl. No.: 370,370

[22] Filed: Jan. 9, 1995

[51] Int. Cl.[6] ..... B66F 9/18

[52] U.S. Cl. ..... 414/607; 414/626; 414/620; 414/908; 414/911; 414/910; 294/97; 294/67.5

[58] Field of Search ..... 414/607, 620, 414/626, 684, 619, 908, 910, 911; 294/67.2, 67.5, 97

[56] References Cited

U.S. PATENT DOCUMENTS

| | | | |
|---|---|---|---|
| 2,680,644 | 6/1954 | Marconi | 294/67.2 |
| 2,803,363 | 8/1957 | Hutchinson | 414/911 X |
| 2,951,725 | 9/1960 | Jean | 294/97 |
| 3,075,664 | 1/1963 | Collings | 414/626 |
| 3,195,751 | 7/1965 | Meyers et al. | 414/607 |
| 3,319,815 | 5/1967 | Vik | 414/607 |
| 3,409,156 | 11/1968 | Mills | 414/607 |
| 3,436,116 | 4/1969 | Anderson | 414/626 X |
| 3,730,368 | 5/1973 | Dalglish | 414/621 |
| 3,734,328 | 5/1973 | Dalglish | 414/620 |
| 3,758,144 | 9/1973 | Dalglish | 294/64.1 |
| 4,154,470 | 5/1979 | Dalglish | 294/93 |
| 4,318,661 | 3/1982 | Helm | 414/607 |
| 4,358,143 | 11/1982 | Cullen | 294/64.1 |
| 4,708,574 | 11/1987 | Conboy et al. | 414/626 X |

FOREIGN PATENT DOCUMENTS

| | | | |
|---|---|---|---|
| 31954 | 5/1956 | Germany | 414/626 |
| 952746 | 10/1956 | Germany | 414/626 |

*Primary Examiner*—David A. Bucci
*Assistant Examiner*—Stephen Gordon

[57] ABSTRACT

The disclosure is directed to convert any fork lift truck to a roll turning fork truck by sliding a specially designed rectangular frame onto the truck forks. Two safety chains are incorporated to firmly attach the device to the fork lift carriage. The frame combines a power winch and cable that engages a roll or coil core via a roll center lift in combination with an arm proceeding out from the roll center lift to the outside mid-width of the roll or coil which is attached to an adjustable fixed length chain. By lowering or raising the winch cable past the fixed length chain, rolls can be turned to either a true horizontal or vertical position. The adjustable "L" frame suspends from the fixed length chain at the lowest point with a pivot pin to achieve the turning feature when the winch cable is activated. Even though a fork truck may be stationary, the center lift is free to guide into the roll because the roll center lift is connected to a flexible cable and flexible chain.

1 Claim, 8 Drawing Sheets

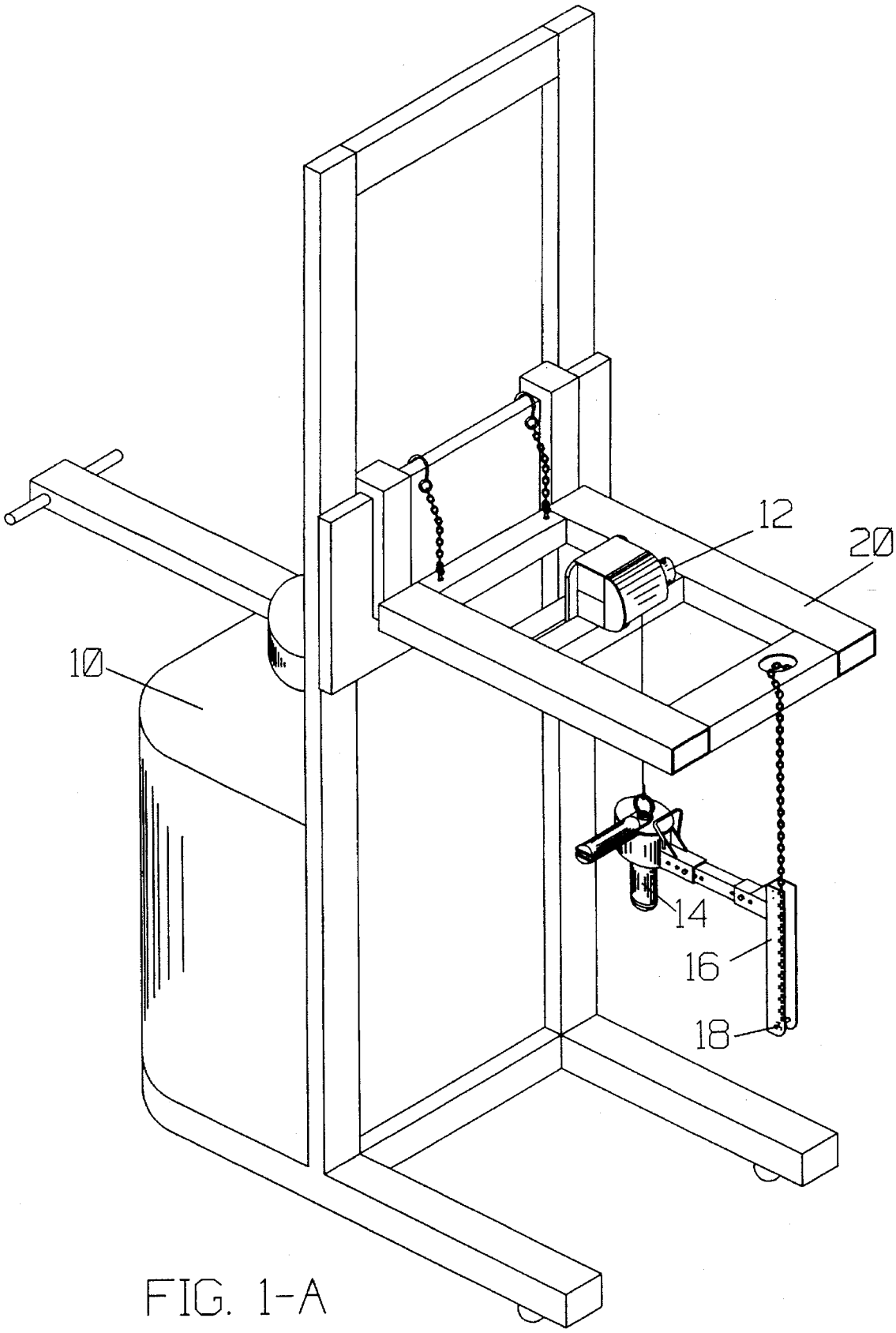
FIG. 1-A

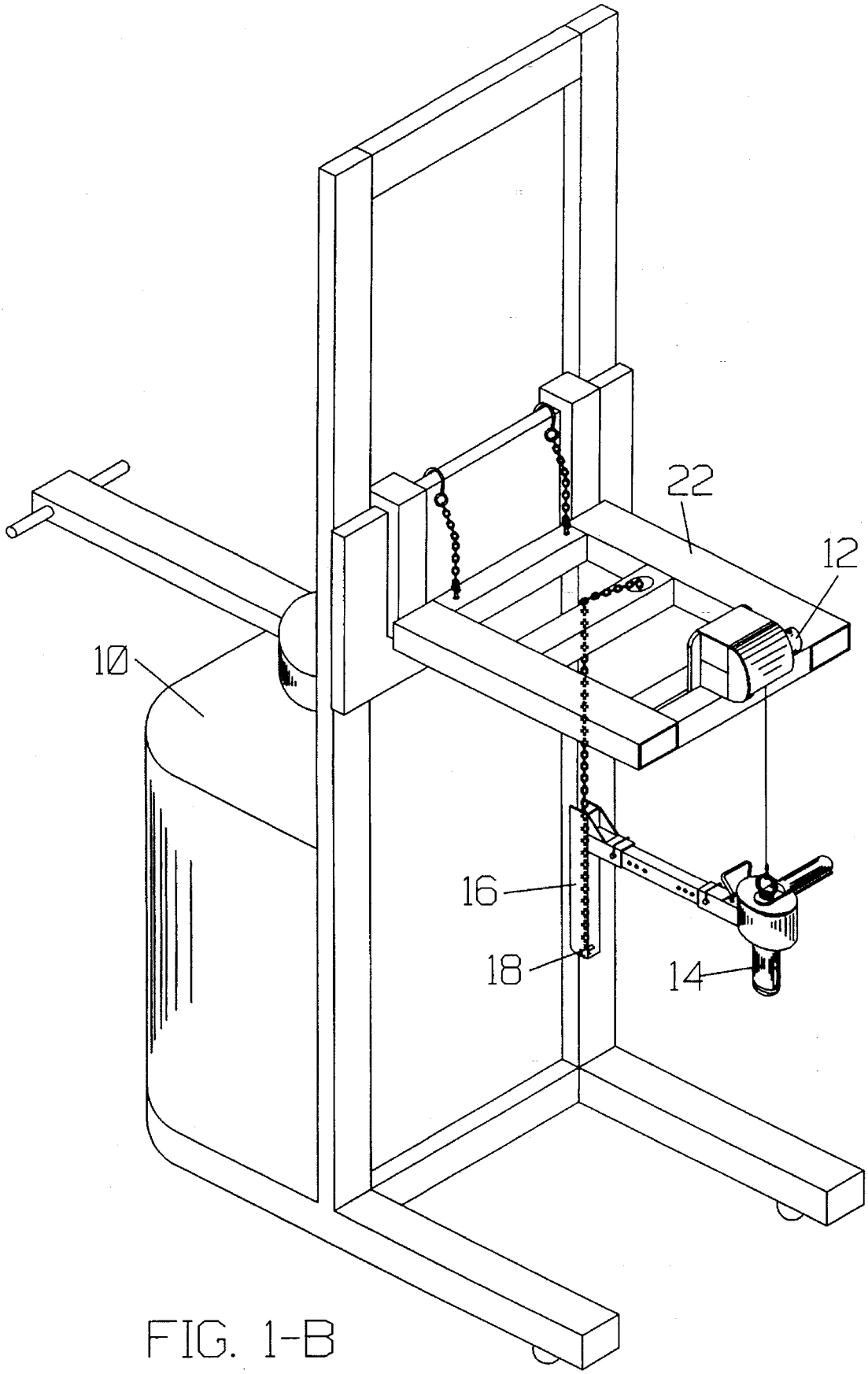
FIG. 1-B

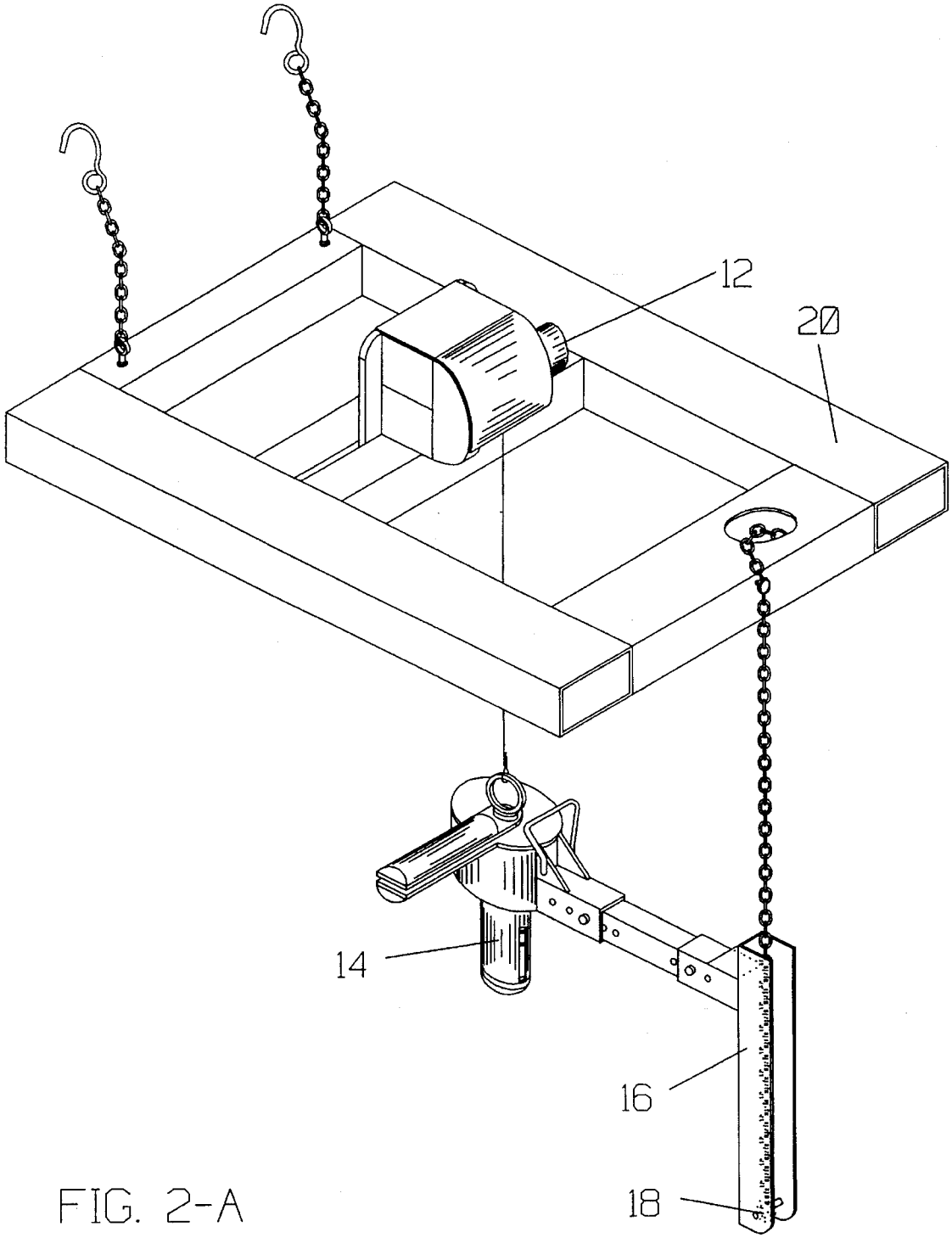
FIG. 2-A

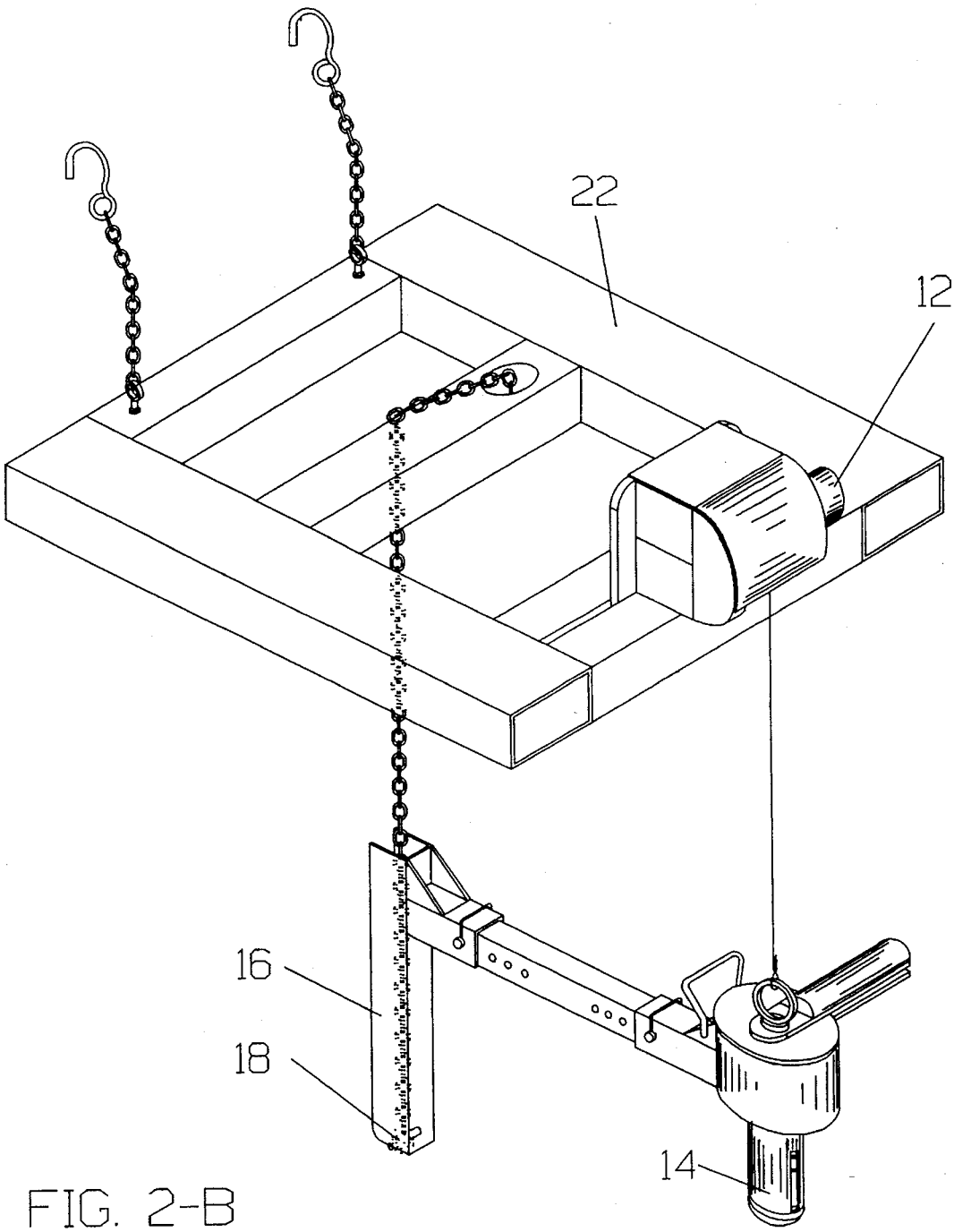
FIG. 2-B

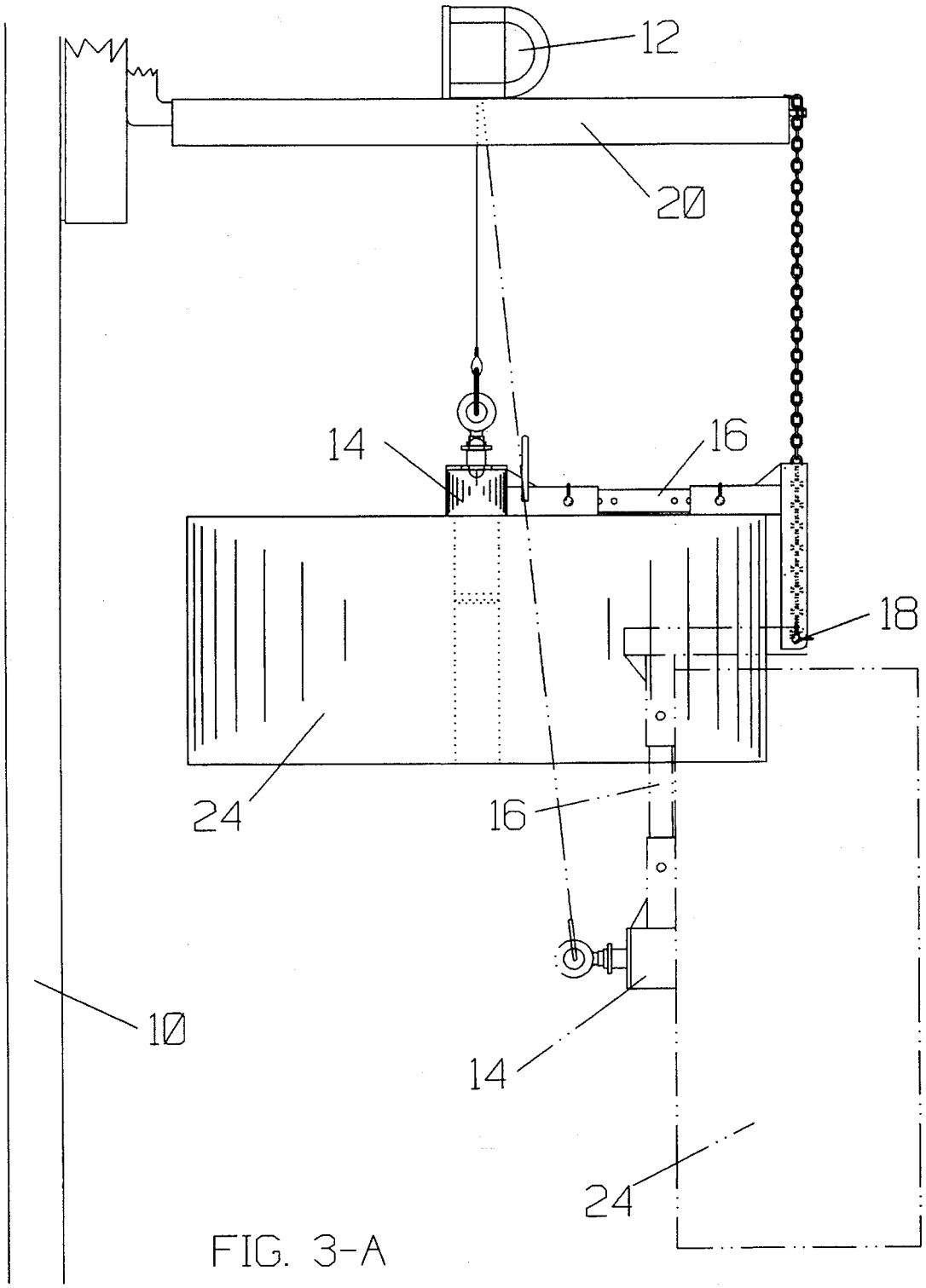
FIG. 3-A

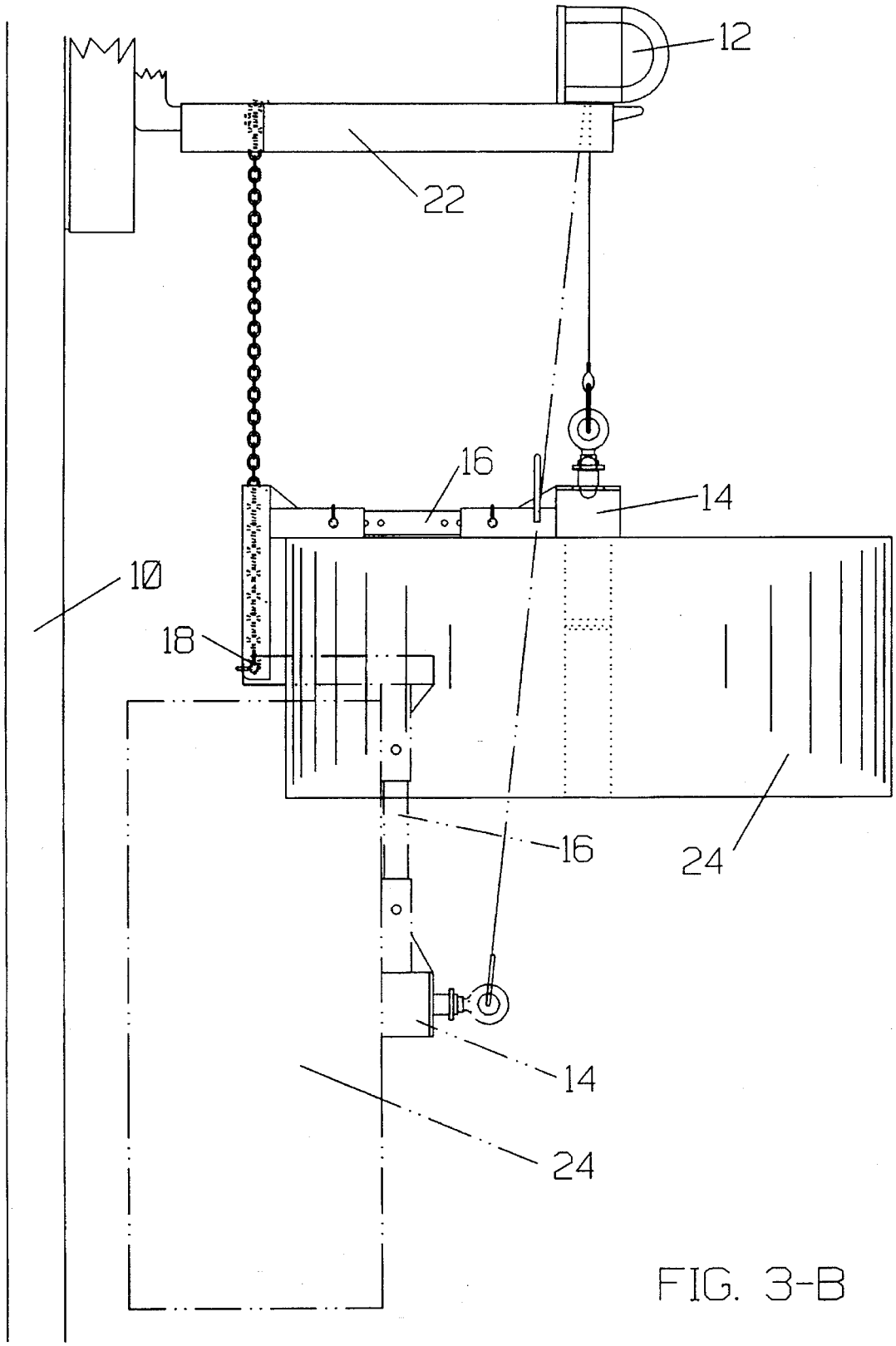
FIG. 3-B

ROLL HANDLING APPARATUS FOR FORK LIFT TRUCKS

BACKGROUND

1. Field of Invention

The invention relates to an apparatus that converts a typical fork lift truck to a roll lifting, turning, and transporting vehicle in a method that revolutionizes a known use of such a truck. See FIG. 1A or 1B.

Buildings being built today, often times, are not structurally designed to suspend heavy overhead cranes for conveying rolls and coils of materials used in production facilities. Also, many older buildings are encumbered with overhead electrical, plumbing, heating, and similar obstacles. Such equipment restricts or prohibits the use of overhead cranes for conveying rolls and coils that are used in the manufacture of products using paper, film, plastic, foil, and similar materials.

2. Description of Prior Art

Patents that have been granted for handling rolls of material in conveying rolls of material wound on cores rely on overhead stacker, bridge, jib, and similar overhead cranes. Such approaches to handling rolls and coils are limited to the overhead environment of a given manufacturing facility. One such patent has been issued to Herbert F. Dalglish, U.S. Pat. No. 4,154,470. Three other related patents by the same inventor are U.S. Pat. Nos. are 3,758,144, 3,734,328, and 3,730,368. One other known patent is by one of the inventors of this disclosure Ralph E. Cullen, U.S. Pat. No. 4,358,143. This patent relates to the above patents and provides the added feature of ease of transfer of a roll of material from a lifting device to a cantilever shaft.

One other device on the market today combines a rigidly mounted center lift, that is rotatable, with a fort lift, and is sold as a complete machine. The operator must locate the lift truck in perfect alignment with the roll core in order to insert the center lift or proper engagement is not possible. When not done properly, product damage occurs or it becomes a time consuming truck maneuvering problem leading to a non-functioning purchase.

OBJECTS AND ADVANTAGES

Our invention is suited to a fork lift truck vehicle that is already found in most, if not all, manufacturing plants. Our invention does not require the dedicated use of a fork lift truck either, but is easily and quickly attached or removed to or from the truck forks as daily roll handling requirements dictate. Our invention, the fork lift truck roll handling apparatus is a positive, practical and unique alternative to the required installation or use of over head cranes.

The Cullen/Sjolund invention, the fork lift truck roll handling attachment, slides on to any typical set of forks, and with a simple power connection to the truck battery, enables the truck operator to lift, turn, and transport rolls of material.

Another very important and cost saving feature with the Cullen/Sjolund invention, the fork lift truck roll handling attachment, is that it offers true horizontal positioning on any roll or coil of material. The Herbert F. Daiglish device, U.S. Pat. No. 4,154,470, using a one point suspension from an overhead crane and chain, will always cause the outer edge of a roll or coil to sustain much of the material weight load when initially lifting or lowering to or from the floor. It has been found that many of these materials are to expensive and sensitive and cannot tolerate such pivotal pressure contact.

There is no need to install an overhead crane system for handling rolls within the parameters of our invention. This reduces the investment required substantially. And to reiterate, this will be the answer for those who occupy buildings that do not have appropriate ceiling structure strength to support an overhead crane system or for those who have overhead obstacles prohibiting that option.

BRIEF DESCRIPTION OF THE DRAWINGS

FIG. 1A is a perspective view of our invention as typically mounted on a walking stacker type fork lift in the "winch in" version.

FIG. 1B is a perspective view of our invention mounted on a typical walking stacker in the "winch out" version.

FIG. 2A is a is a perspective view of the invention itself in the "winch in" version.

FIG. 2B is a is a perspective view of the invention itself with the winch in the "winch out" position.

FIG. 3A is a 2 dimensional view of the invention with the winch in the "winch in" position shown with a roll both vertical and horizontal.

FIG. 3B is a 2 dimensional view of the invention with the winch in the "winch out" position shown with a roll both vertical and horizontal.

REFERENCE NUMERALS

Figure 4:
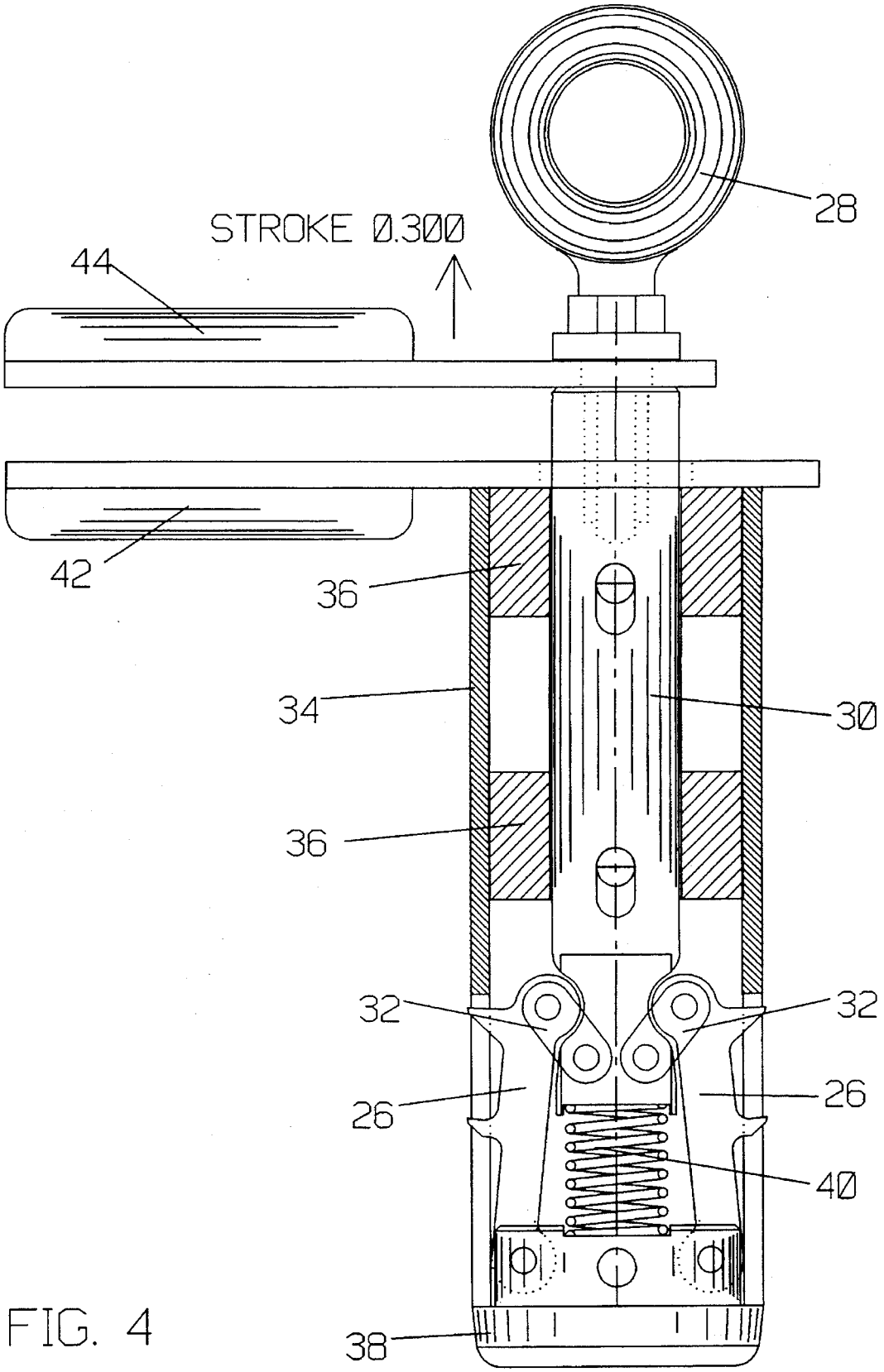
FIG. 4 is a crossectional view of the roll center lift device when in the disengaged mode.

10 fork lift truck
12 winch
14 roll center lift
16 L"shaped arm
18 pivot pin
20 base frame A
22 base frame B
24 roll of material
26 gripper
28 lifting eye
30 lifting shaft
32 linkage
34 housing
36 linear bearing
38 nose piece
40 spring
42 lower handle
44 upper handle

SUMMARY

Our invention is designed to convert any fork lift truck to a roll turning and transporting truck by sliding our apparatus onto the forks of the truck and safely attaching it with two safety chains to the fork carriage. Raising or lowering the apparatus is provided by the fork lift system. Our apparatus provides for the turning of the roll of material. The apparatus includes a frame constructed of rectangular steel tubing, welded together to form the base. An electric which is the source of motion, and power is obtained from the fork lift batteries through and electric cable. Control is through a switch box and an umbilical cord connected to the winch motor. The winch cable is connected to the roll center lift probe which is assembled as a part of an "L" shaped arm that is also pivotally attached to the base frame through the use of a chain. Lifting of a roll of material is made possible by the cable from the winch and a chain connected to the base frame. The fork lift is driven to a location approximately over the core of a roll of material where the operator can lower the forks and manually slip the probe into the core. Precise location is not required because of the flexible attachment of the probe to the base frame. The probe will engage itself with the core and grip it firmly. As the fork lift is activated to raise the roll the apparatus is also raised lifting the roll of material. The roll of material can then be turned from vertical to horizontal by activating the winch such that the cable is extended until the roll reaches the horizontal position. Lifting a roll that is horizontally positioned and turning it to the vertical position is also possible with this apparatus.

PREFERRED EMBODIMENT—DESCRIPTION

The Cullen/Sjolund invention, FIG. 2A or 2B, consists of a rectangular base frame A20 or base frame B incorporating a power D.C. winch 12, a roll center lift 14 suspended from the winch 12 cable, and an "L" shaped arm 16 that projects out from the roll center lift 14 connecting to a fixed length chain at its lower point. The lower end of the chain is connected to a pivot pin 18.

FIG. 1A illustrates our invention in the "winch in" version mounted on a typical walking stacker type of fork lift truck 10. As shown, the truck has become a roll turning vehicle. The base frame A20 of our invention is mounted directly on the forks of the truck and is safely attached using two chains and hooks to the truck carriage. Power for our invention is supplied by the batteries of the fork truck through a cable and receptical. Further cabling is attached to the base frame A20 of our invention and is connected to the receptical of the fork truck with a common D.C. plug. The reason for the connection is to operate the roll turning winch. The fork truck is used to provide up and down motion of our invention as well as transporting the material within the plant. The winch is used to rotate the roll of material from vertical to horizontal or the reverse.

FIG. 1B illustrates our invention in another "winch out" version as mounted on a typical fork lift truck 10. This version uses base frame B22. The description is the same as above only the operation turns the roll in the opposite direction.

FIG. 2A illustrates our invention itself in the "winch in" version. The base frame A20 of the invention is constructed of rectangular steel tubing and steel plate. It is electrically welded together to form a shape that adapts to typical truck forks. A chain is suspended from the frame in a way such that its length is variable for different roll handling situations but during operation it remains fixed. The lower end of the chain is attached to the "L" shaped arm 16 with a pivot pin 18. Winch 12 is mounted on a steel plate welded to the base frame A20. The winch 12 cable is attached to roll center lift 14 and operates in harmony with the chain to suspend the roll of material 24.

FIG. 2B illustrates our invention itself in the "winch out" version. This version uses base frame B22 and operates in the opposite direction relative to the direction the roll of material 24 faces.

FIG. 3A & 3B illustrate in two dimensions, the operation of the invention in roll turning.

FIG. 4 illustrates, in detail, the parts included in the roll center lift 14 in the gripper 26 retracted position. The roll center lift 14 is built of many parts. Starting from the top the lifting eye 28 provides the attachment point for winch 12 through a cable and hook. Lifting eye 28 is connected to lifting shaft 30, and both linkage 32 parts are pinned to it. Linkage 32 parts are pinned to gripper 26 parts. The device housing 34 is the cylindrical cover and the linear bearings 36 are there to guide the motion of the lifting shaft 30. The nose piece 38 of the roll center lift 14 supports the linkage base pins, with a spring 40 to hold the grippers 26 out. The remaining parts consist of the lower handle 42, and the upper handle 44.

Figure 5:
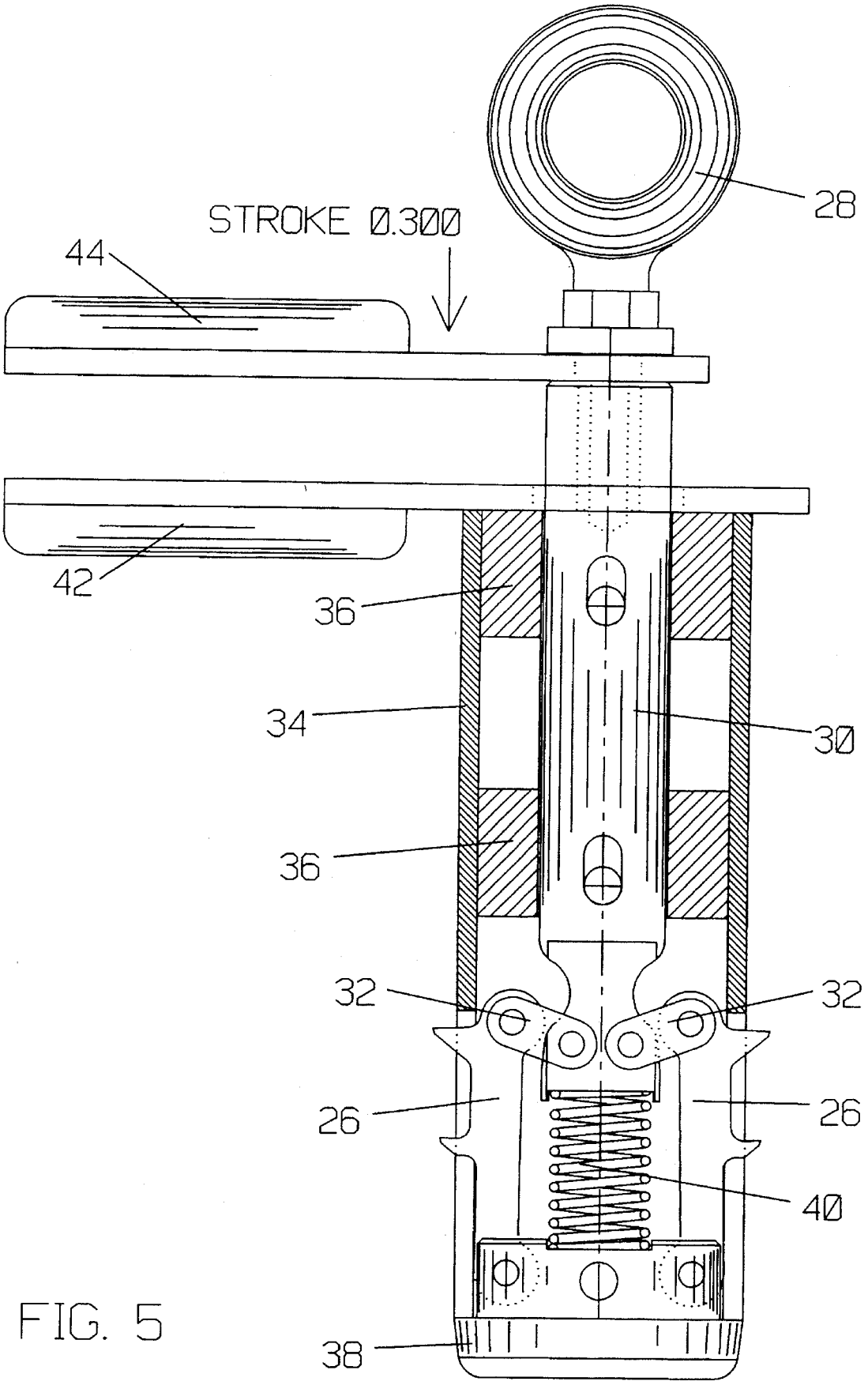
FIG. 5 is a crossectional view of the roll center lift when actuated and during lift operation.

FIG. 5 illustrates, in detail, the parts included in the roll center lift 14 in the gripper 26 engaged position. All parts and descriptions are the same as the paragraph above.

PREFERRED EMBODIMENT—OPERATION

FIG. 1A & 1B illustrate the operation possibilities of our invention in conjunction with a fort lift truck 10. The fork lift truck 10is used to get up and down motion while our invention is used to get the rotary motion of a roll of material. A typical use of our invention would be to drive the fork lift truck 10 over to a pallet supporting rolls of material. The forks with our invention will be at a height high enough so the complete device will clear the rolls. At this point the truck will be steered such that the roll center lift 14 will be generally over the core I.D. The flexibility of our invention now shows its advantage when the core roll center lift 14 can be lowered and manually guided into the I.D. without perfect alignment of the truck. The roll center lift 14 is slipped into the roll core, and the handles of the roll center lift can be depressed to permit the easiest entry. As the forks of the truck are raised the grippers 26 of the roll center lift 14 will dig into the core engaging it firmly and permitting the fork lift truck 10 to lift the roll of material 24. The heavier the roll of material the firmer the grip will be.

FIG. 2A & 2B illustrate the same function as FIG. 1A & 1B but with a close up view.

FIG. 3A & 3B illustrate the rotary motion of the roll of material 24 as provided by our invention. The forks are raised to a height which will permit the roll to be turned with out the roll edge hitting the floor.

FIG. 3A shows the "winch in" version of the invention. Winch 12 cable is in the retracted position and the roll of material 24 in the vertical position. As the change is made from cable retracted to cable extended position the L" shaped arm 16, with roll of material 24, will rotate about the pivot pin 18 at the end of the chain. The roll rotation can be stopped when the roll reaches a true horizontal position, and the bottom of the roll will now be facing away from the fork lift truck 10. In this position the roll can be placed by a printing or converting machine in a correct mode for production unwinding.

FIG. 3B shows the "winch out" version of the invention. The operation is the same as in the first version, however the roll of material 24 bottom ends up facing the fork lift truck 10.

In both FIG. 3A & 3B the adjustability of the L" shaped arm 16 is shown. The L" shaped arm 16 arm can be extended or retracted to accommodate various diameters of roll material. The L" shaped arm 16 leg effective length can also be changed to accomodate different widths of rolls by moving the pivot pin 18 to different hole locations.

FIG. 4 and 5 illustrate the operation of the roll center lift 14. FIG. 4 shows the crossectional view of the roll center lift 14 when the grippers 26 are disengaged. This is the position of the internal parts when the roll center lift 14 is slipped into the core of a roll. This position is achieved automatically by insertion into a core or by depressing the handles 42 & 44 and overcoming the spring 40. To achieve an engagement with the core one only needs to start to lift the roll with the lifting eye 28 at the top of the device. As the lifting shaft 30 rises it will start to rotate linkages 32 and thereby rotate grippers 26 which penetrate the core firmly engaging it and permitting the roll of material 24 to be lifted.

OTHER EMBODIMENTS

Electric Actuator, Linear or Rotary—Description

Numerous types of linear or rotary acuators are commercially available that could be used to lower or raise the roll center lift. We have chosen the winch because of its low cost and long stroke.

Electric Actuator, Linear or Rotary—Operation

A standard A.C., D.C., or stepper motor driven actuator could be used in conjunction with a system of levers and cables to increase the stroke. This operation would not be as convenient, but could replace the winch.

Pneumatic or Hydraulic Actuator—Description

Pneumatic, hydraulic, electro-pneumatic, or electro-hydraulic actuators are commercially available that could be used to lower or raise the eye of the center lift.

Pneumatic or Hydraulic Actuator—Operation

Pneumatic or Hydraulic actuators or electro-hydraulic and electro=pneumatic actuators could be used directly or indirectly through cables to provide the required motion to rotate the roll of material. Again expense is a major deterent.

Other Various Center Lift Designs—Description

We will not propose other center lift designs, but many are available, and many more could be designed. Many of these designs could be used directly.

Other Various Center Lift Designs—Operation

There are many commercially available designs, some that are self energizing like ours and others that must be actuated manually or with some outside source of power.

Conclusions, Ramifications, and Scope

Accordingly, it can be seen that our invention has significant advantages over all previous art. Our invention has a major advantage in its flexibility when approaching the core of material therefore not requiring perfect alignment. The invention also provides readily, a true horizontal position of the roll of material. It also is economical not requiring a committed fork lift or over head bridge system for a crane.

Although the description above contains many specificities, these should not be construed as limiting the scope of the invention but as merely providing illustrations of some of the presently preferred embodiments of this invention. Various other embodiments and ramifications are possible within it's scope. For example, the invention could also be a part of a dedicated machine or it could use other electric, pneumatic, or hydraulic means of actuation rather than the chosen winch. It could use chains instead of cables and cables instead of chains. Also ropes could be used in all locations. Ramifications like these are possible within the scope of this invention.

Thus the scope of the invention should be determined by the appended claims and their legal equivalents, rather than by the examples given.

What is claimed is:

1. An apparatus for lifting and rotating a roll of material having an accessible axial core opening, comprising:

a rectangular frame comprised of four frame members of varying size welded together and designed to fit onto the forks of a conventional fork lift truck, each member comprising a rectangular tube;

an L-shaped arm;

a probe having first and second ends, the first end constructed for insertion into the core opening of a said roll and including gripping means comprising expansion means for expanding and gripping the inside of the core opening, said second end being connected to said arm;

flexible vertical support means having first and second ends and being pivotally connected to a pivot point on said arm at said first end of said support means and connected to said frame at said second end of said support means;

a second flexible vertical support means having first and second ends, said second end of said second support means being connected to said probe;

control and power means connected to said frame and operatively connected to said first end of said second support means to permit controlled extension and retraction of the second support means to thereby provide for rotation of a handled said roll from vertical to horizontal or the reverse;

wherein said control and power means comprises an electric winch, and said second support means comprises a chain.

* * * * *